US006382552B1

(12) United States Patent
Paul et al.

(10) Patent No.: US 6,382,552 B1
(45) Date of Patent: May 7, 2002

(54) MOIST TISSUE DISPENSER

(75) Inventors: DeWitt J. Paul, Santa Ana; Barry E. Williams, San Clemente, both of CA (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/577,462

(22) Filed: May 24, 2000

(51) Int. Cl.[7] ..... B65M 16/02; B65M 18/02

(52) U.S. Cl. ..... 242/595; 242/594.5; 242/598.5; 242/598.3; 242/599.1

(58) Field of Search ..... 242/595, 594.5, 242/598.5, 598.3, 599.1

(56) References Cited

U.S. PATENT DOCUMENTS

| | | | | |
|---|---|---|---|---|
| 1,913,363 | A | | 6/1933 | Allen |
| 2,220,230 | A | | 11/1940 | Gilbert |
| 2,643,069 | A | | 6/1953 | Carlin |
| 3,310,353 | A | | 3/1967 | Cordis |
| 3,794,253 | A | | 2/1974 | Megdall |
| 3,799,467 | A | | 3/1974 | Bauman |
| 3,830,198 | A | | 8/1974 | Boone |
| 3,837,595 | A | | 9/1974 | Boone |
| 3,881,210 | A | | 5/1975 | Drach et al. |
| 3,910,229 | A | | 10/1975 | Spencer |
| 3,943,859 | A | | 3/1976 | Boone |
| 3,995,582 | A | | 12/1976 | Douglas |
| 4,004,687 | A | | 1/1977 | Boone |
| 4,106,616 | A | | 8/1978 | Boone |
| 4,106,617 | A | | 8/1978 | Boone |
| 4,124,259 | A | | 11/1978 | Harris |
| 4,205,802 | A | | 6/1980 | Economakis |
| 4,235,333 | A | | 11/1980 | Boone |
| 4,427,159 | A | | 1/1984 | Miller et al. |
| 4,901,889 | A | | 2/1990 | Mitchell |
| 4,978,095 | A | | 12/1990 | Phillips |
| 5,012,986 | A | | 5/1991 | Needle |
| 5,311,986 | A | | 5/1994 | Putz |
| 5,542,568 | A | * | 8/1996 | Julius ..... 221/63 |
| 5,660,313 | A | * | 8/1997 | Newbold ..... 225/42 |
| 5,765,717 | A | | 6/1998 | Gottselig |
| 5,897,074 | A | | 4/1999 | Marino |
| 5,950,960 | A | | 9/1999 | Marino |
| 6,082,664 | A | | 7/2000 | Phelps et al. |
| 6,098,836 | A | | 8/2000 | Gottselig |
| 6,138,939 | A | | 10/2000 | Phelps et al. |
| 6,170,698 | B1 | | 1/2001 | Phelps et al. |

FOREIGN PATENT DOCUMENTS

| | | |
|---|---|---|
| DE | 29719026 U1 | 3/1998 |
| EP | 1048257 | 11/2000 |
| WO | WO 98/08763 | 3/1998 |
| WO | WO 00/35327 | 6/2000 |
| WO | WO 00/65973 | 11/2000 |
| WO | WO 00/65974 | 11/2000 |
| WO | WO 00/65975 | 11/2000 |
| WO | WO 00/65976 | 11/2000 |
| WO | WO 01/76436 | 10/2001 |
| WO | WO 01/76437 | 10/2001 |
| WO | WO 01/76438 | 10/2001 |
| WO | WO 01/76439 | 10/2001 |
| WO | WO 01/76440 | 10/2001 |
| WO | WO 01/76441 | 10/2001 |
| WO | WO 01/76442 | 10/2001 |
| WO | WO 01/76443 | 10/2001 |

OTHER PUBLICATIONS

Wet Tissue Product And Dispenser Marketed Under the Name Of "Swashes" in Hong Kong by Delong Chemical.

* cited by examiner

*Primary Examiner*—Donald P. Walsh
*Assistant Examiner*—Jonathan R Miller
(74) *Attorney, Agent, or Firm*—Julia A. Glazer; David M. Weirich; Ken K. Patel

(57) ABSTRACT

A dispenser for moist tissue is provided including a housing formed of two housing sections for a moist tissue roll, a dispenser slit having a stepped inner surface configuration and a retaining latch. The retaining latch limits the degree of opening of the housing sections which are joined by a hinge. The dispenser is positioned for use by two arms attached to a housing section.

10 Claims, 6 Drawing Sheets

MOIST TISSUE DISPENSER

BACKGROUND OF THE INVENTION

This invention relates to a dispenser for moist tissues. More particularly, the present invention relates to a dispenser for moist tissues which effectively seals moist tissue housed within the dispenser to maintain it moist and which includes means for hanging the dispenser such as from a conventional toilet tissue holder.

Premoistened tissues are formed from a highly absorbent sheet material such as tissue paper or tissue paper which may contain polymeric fibers that provides strength to the tissue paper and which are moistened with a liquid cleansing agent. The cleansing agent may also contain a medicament, deodorant or the like. Since the tissue is moist, it must be stored in a container which seals the tissue from the atmosphere surrounding the dispenser in order to prevent liquid from evaporating from the tissue. In addition, the dispenser must permit ease of access to moist tissue for the user so that it can be easily dispensed in the desired amount by the user. The requirements for sealing and ease of access present conflicting criteria since the ease of access requirement also requires that at least a portion of the moist tissue be readily accessible to the user without opening the dispenser. Thus, the exposed tissue provides a means for allowing evaporation from the moist tissue stored in the dispenser which evaporation is to be minimized.

It is also desirable that the dispenser can be conveniently stored in the area of use, which is primarily the bathroom portion of a living area. In addition, it is desirable that the dispenser be reusable so that, after all of the moist tissue has been used, the dispenser can be opened to insert a new supply of moist tissue. Thus, the dispenser must be capable of being resealed after a new supply of moist tissue has been added to the dispenser. Since the moist tissue normally is used in the bathroom, it would be desirable to provide a means for storing the dispenser which cooperates with conventional bathroom fixtures such as a spindle upon which a roll of dry toilet paper wound about a hollow core is stored. Such a storage means would provide the user with a convenient choice of dry or moist tissue.

U.S. Pat. No. 5,897,074 discloses a dispenser for moist tissue having a cylindrical housing formed of two housing sections. Each housing section has an arm attached to it. The arms function both to support the dispenser and to seal the two housing sections together to minimize evaporation from the moist tissue.

U.S. Pat. No. 3,837,595 discloses a dispenser for moist tissue roll in the form of a cylindrical housing. The cylindrical housing includes an open cylinder and one or more circular sealing rims which close and seal the openings in the cylinder. The cylinder contains a slot through which the moist tissue is dispensed. When it is desired to replace a roll of moist tissue, the sealing rim or rims are detached from the cylinder, a new roll of moist tissue is placed into the cylinder and the end of the roll is rethreaded through the slot in the cylinder. In addition, the sealing rims must be properly positioned to effect desired sealing to prevent moisture evaporation from the new roll. This dispenser is undesirable since it cannot be utilized with a conventional bathroom tissue support structure which includes a spindle.

U.S. Pat. No. 4,235,333 discloses a dispensing device for moist tissue which must be affixed to a bathroom wall. In addition, when the tissue is dispensed from the dispenser, a cover must be lifted to permit access to the moist tissue. While the cover is lifted, a liquid evaporates from the tissue so that it eventually becomes undesirably dry.

U.S. Pat. No. 3,310,353 discloses a dispenser for moist tissue. The dispenser has a cylindrical configuration formed from two sections which are hinged together. The interior of the dispenser is sealed from the surrounding atmosphere either with a spring loaded plate at the dispenser exit or with an auxiliary storing means for added liquid through which the moist tissue is passed. No means are provided for storing the dispenser on a conventional spindle for toilet paper.

Accordingly, it would be desirable to provide a dispenser for moist tissue which permits dispensing a desirable length of tissue while sealing the moist tissue from the atmosphere to prevent tissue drying. In addition, it would be desirable to provide such a dispenser which permits dispensing tissue without opening the dispenser. In addition, it would be desirable to provide such a dispenser which can be secured to existing conventional storing means for dry toilet tissue. Furthermore, it would be desirable to provide such a dispenser which also can be positioned on or against a horizontal or vertical flat surface to provide convenience in dispensing moist tissue at a variety of locations.

SUMMARY OF THE INVENTION

This invention provides a dispenser for moist tissue formed with two housing sections joined together by a sealed hinged means and which are also capable of being secured together with two sealing latches positioned at opposite ends of the dispenser. Two arms adapted to be secured to a fixed element are secured to a housing section so that the dispenser can be hung from the fixed element. At least one retaining latch is secured to a housing section. The retaining latch or latches function to limit the distance between the housing sections when the dispenser is opened. A leading edge of tissue housed within the dispenser is positioned within a slit defined by the juncture of flanges of the two housing sections. A flange is provided on each housing section at the slit so that tissue being dispensed must be passed between the flanges prior to being detached from the tissue within the dispenser by the user. The flanges include mating step surfaces that extend substantially along the width of the slit so that the step surfaces provide a sealing means for the tissue positioned within the dispenser and thereby prevent excessive evaporation of liquid from the tissue. The sealing latches, when secured, function to maintain the step surfaces in a sealing position. When the sealing latches are released, the dispenser can be opened. The arms utilized to hang the dispenser also can be provided with means for folding them in a compact position so that the entire dispenser, including the arms can be easily packaged during manufacture for shipment to a desired point of use. The dispenser also can be provided with means for supporting it on a relatively flat horizontal surface or a relatively flat vertical surface.

DESCRIPTION OF SPECIFIC EMBODIMENTS

The tissue dispenser of this invention is capable of being hung from a fixed support, positioned on a relatively flat horizontal surface or positioned on relatively flat vertical surface. The dispenser of this invention is formed of two housing sections and is capable of housing moist tissue and maintaining it moist by preventing evaporation of liquid in the moist tissue during storage. In addition, the dispenser of this invention permits removal of desired lengths of tissue without opening the dispenser. The tissue dispenser of this invention includes a tissue dispensing slit defined, by the position of two flanges, each on one of the housing sections. The flanges include mating step sections formed of at least two steps. The two housing sections are joined together in sealing relationships by sealing latches which position the step sections together in mating relationship. At least one retaining latch attached to one of the housing sections is releasably attachable to the other of the housing sections and is provided with a stop configuration. The retaining latch limits the distance between the two housing sections when the dispenser is opened so that a roll of moist tissue is retained within the dispenser even when opened. The roll of moist tissue which is preferably utilized in the dispenser of this invention comprises a solid roll of tissue which is wound upon itself rather than being wound around a centrally positioned support arm such as an open cylinder formed of a deformable material such as cardboard or left with a central hole with no support.

Figure 1:
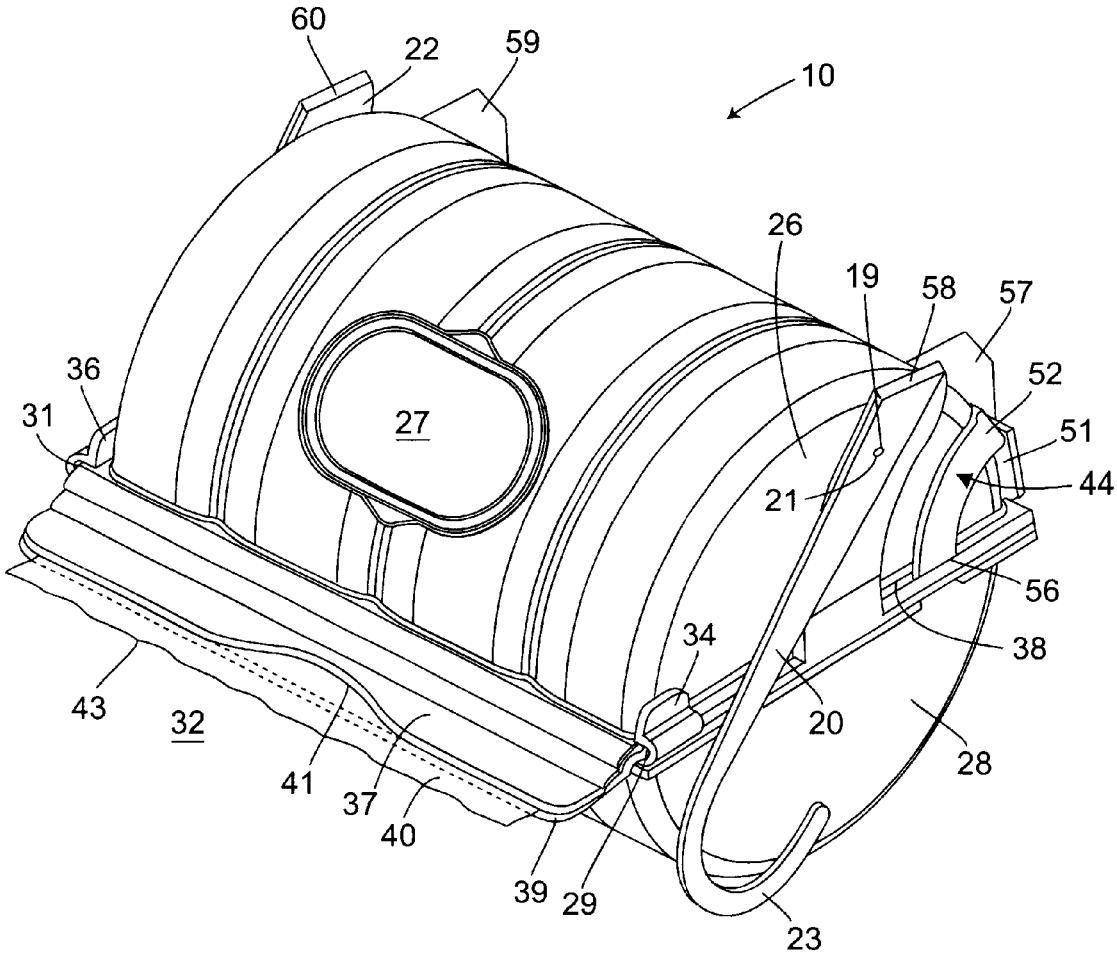
FIG. 1 is a top isometric view of an embodiment of the dispenser of this invention in position for use.
Figure 1A:
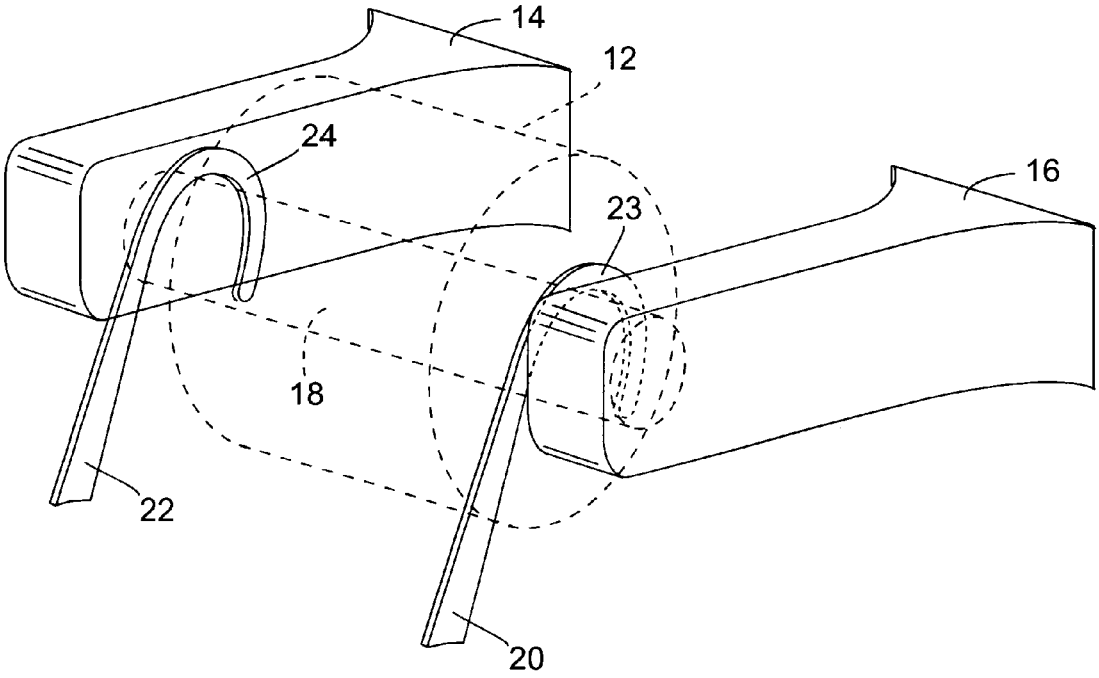
FIG. 1*a* is a view of a conventional tissue roll holder from which the dispenser of this invention can be hung.
Figure 2:
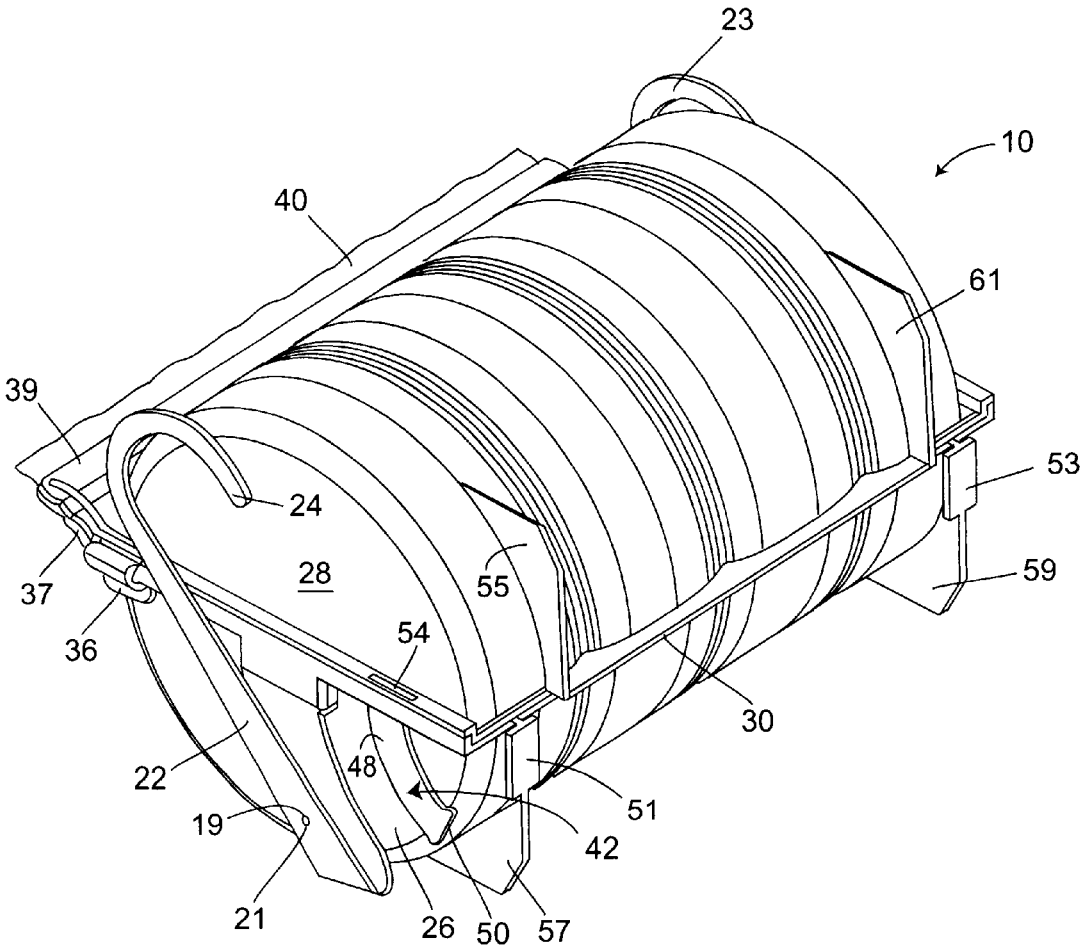
FIG. 2 is a bottom isometric view of the dispenser of FIG. 1.

Referring to FIGS. 1, 1*a* and 2, a dispenser of this invention 10 is configured to be hung from a conventional bathroom fixture for housing dry tissue 12 which includes two prongs 14 and 16 each having recesses to accommodate each end of a spring loaded spindle 18. A roll of toilet tissue 12 has a centrally located hole through which spindle 18 extends. The spindle 18 can be removed from the prongs 14 and 16 by compressing a spring (not shown) therein so that the roll of tissue 12 can be replaced by a new roll of tissue.

The dispenser 10 of this invention includes two arms 20 and 22. Each of the arms 20 and 22 includes a hooked end 23 or 24 to accommodate spindle 18. Alternatively, the ends of the hooks 23 or 24 can be connected to the arms 20 and 22 to form openings through which the spindle 18 extends can be utilized rather than a hook to hang the dispenser. The arms 20 and 22 are positioned between the tissue roll 12 and one of the prongs 14 and 16. The arms 20 and 22 can be folded by means of being snap fit through holes 19 which snap fit on extensions 21. A housing 27 formed of housing sections 26 and 28 are joined together by a rearward hinge 30 which seals the interior of the housing formed from housing sections 26 and 28 from the surrounding atmosphere 32. The interior of the housing 27 also is sealed from the outside atmosphere 32 by sealing latches 34 and 36. The sealing latches 34 and 36 clamp onto raised bars 29 and 31 so that a seal is effected along joining line 38 of housing sections 26 and 28 between the atmosphere 32 and the interior of dispenser 27. A flange 37 on housing 26 is retained sufficiently close to the flange 39 on housing section 28 so that, together with the moist tissue 40 positioned between the two flanges 37 and 39, an effective seal is formed between the atmosphere 32 and the interior of dispenser 10. Sealing also is effected by means of a stepped configuration of the interior surfaces of the flanges 37 and 39 which will be discussed below in detail with reference to FIG. 4. Thus, the interior of housing 27 is sealed from the atmosphere by means of a rearward hinge 30, sealing latch means comprising sealing latches 34 and 36 which form a seal at line 38 which extends along both side surfaces of the housing and the seal formed by the step configuration of the flanges 37 and 39 (FIG. 4) and the moist tissue 40. A slot 41 can be formed in flange 37. The slot 41 is useful for the user since it exposes a portion of the tissue 40 so that the user can use a finger and/or thumb to pull the leading edge 43 of the tissue 40 away from the interior of housing 27. The tissue 40 optionally can be segmented by partial slits extending across the width of tissue 40.

The housing section 28 also includes retaining latches 42 and 44 which are formed integrally with housing section 28. The retaining latches 42 and 44 include an arm 46 or 48 and an end 50 or 52 which is slightly wider than arm 46 or 48. The retaining latches 42 and 44 are formed of a flexible material such as a conventional moldable plastic composition so that the ends 50 and 52 can be manually forced through openings 54 or 56 when the dispenser 10 is constructed. However, the ends 50 and 52 are sufficiently rigid so that they are retained by the walls or the openings 54 or 56 when the dispenser 10 is open by separating housing sections 26 and 28. By configuring the retaining latches 42 and 44, in this manner, the housing sections 26 and 28 are separated a distance defined by the length of arms 46 and 48 so that a roll of moist tissue can be positioned within housing section 28 without falling from the housing section 28. Thus, the retaining latches 42 and 44 perform the important function of permitting the refilling of the dispenser 10 with a roll of moist tissue in an effective and sanitary manner. It is to be understood that only one retaining latch 42 or 44 can be utilized. However, it is preferred to utilize two retaining latches. It is also to be understood that retaining latches 42 and 44 can be formed integrally with housing section 26 while positioning the openings 54 and 56 on housing section 28. It is only necessary that the retaining latches 42 and 44 fix the open position of the housing sections 26 and 28 when empty or when containing a roll of moist tissue.

Also, as shown in FIGS. 1 and 2, the dispenser of this invention can be provided with retaining plates 51 and 53 which can be fit into a conventional wall bracket (not shown) to retain dispenser on a wall. The dispenser 10 also can be provided with flanges 55, 57, 59 and 61 so that the dispenser can be rested on a horizontal surface.

Figure 3:
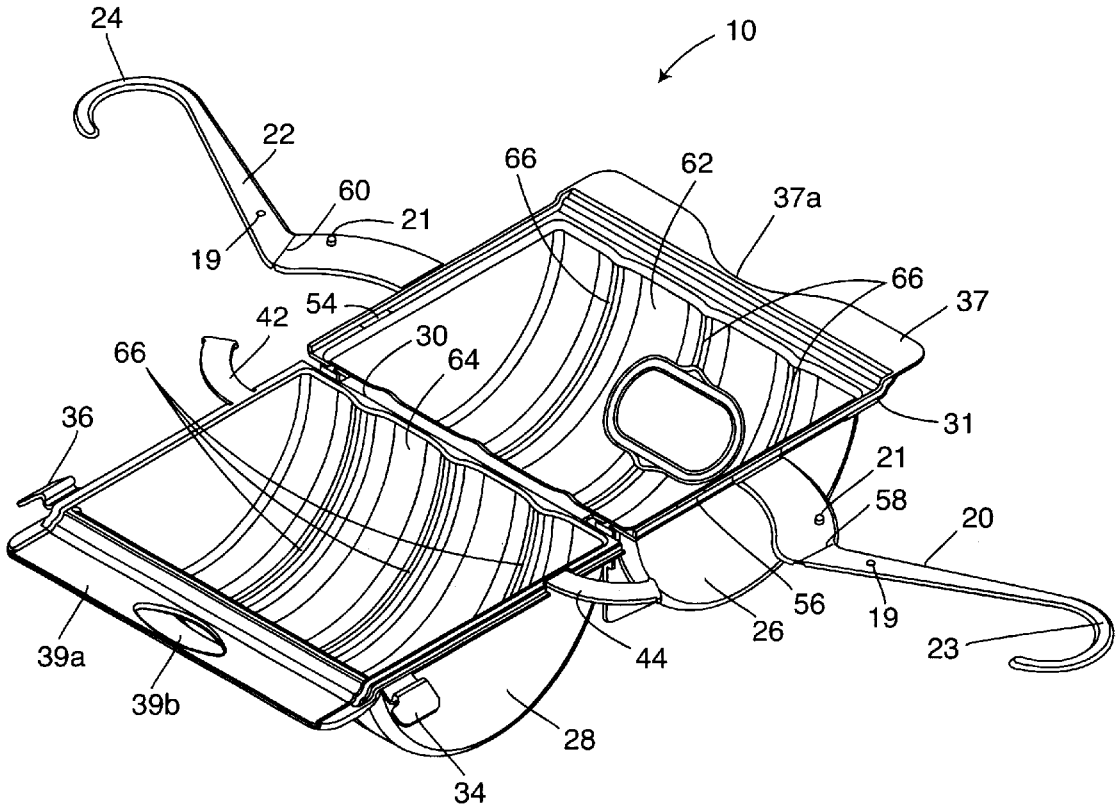
FIG. 3 is an isometric view of the interior surfaces of the dispenser of FIGS. 1 and 2

Referring to FIG. 3, the dispenser 10 is shown in a completely open position prior to positioning retaining latches 42 and 44 within holes 54 and 56. The arms 22 and 24 are shown in an extended position with the living hinges 58 and 60 being open. The living hinges 58 and 60 are formed by any conventional plastic molding method wherein the living hinges 58 and 60 have a smaller thickness than the arms 22 and 24 so that the arms 22 and 24 can be bent about the living hinges 58 and 60. As shown in FIG. 3, the interior surface 62 of housing section 26 and the interior surface 64 of housing section 28 are provided with reinforcing ridges 66. The reinforcing ridges 66 extend above the surfaces 62 and 64 so that the roll of moist tissue housed within the dispenser 10 is subjected to reduced surface friction since it contacts a reduced surface area of the reinforcing ridges 66 rather than the entire surface areas of surfaces 62 and 64. As shown in FIG. 3, the flange 39*a* is provided with a hole 39*b* so that the user can position a finger to cooperate with the user's thumb that extends into indentation 37*a* of flange 37 to grasp and pull the leading edge of a tissue roll from the dispenser 10.

Figure 4:
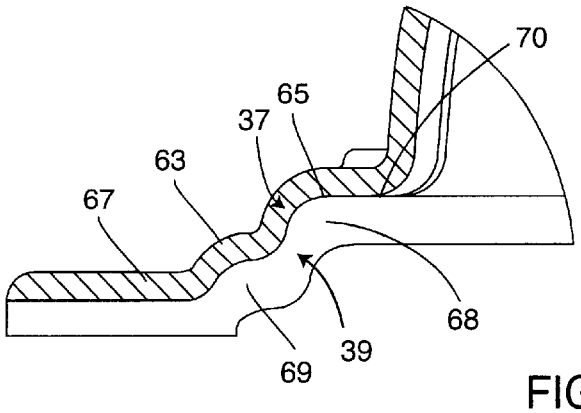
FIG. 4 is a partial cross-sectional view of the step surfaces for sealing the flange at the tissue dispensing slit of the dispenser of FIGS. 1, 2 and 3.

Referring to FIG. 4, the essential step surface configuration of the flanges 37 and 39 or 39*a* is shown. The flange 37 includes three steps, 65, 63 and 67 while flange 39 includes two steps 68 and 69 which mate with steps 65, 63 and 67 to define tortuous pathway 70 between the two flanges 37 and 39 for the moist tissue being dispensed from dispenser 10. The steps 65, 63, 67, 68 and 69 are formed about 90° turns. The flanges 37 and 39 are retained together in the position shown in FIG. 4 by the sealing latches 34 and 36 in the manner described above. The flanges 37 and 39 are maintained a distance apart to permit passage therebetween of the moist tissue while sealing the interior of the dispenser 10 from the surrounding atmosphere 32. Typically, the distance between the steps 65, 63 and 67 from 68 and 69 is between about 2 times and about 4 times the thickness of the moist tissue sheet. This step configuration prevents the tissue passed between the flanges from being pulled back into the interior of dispenser 10.

Figure 5:
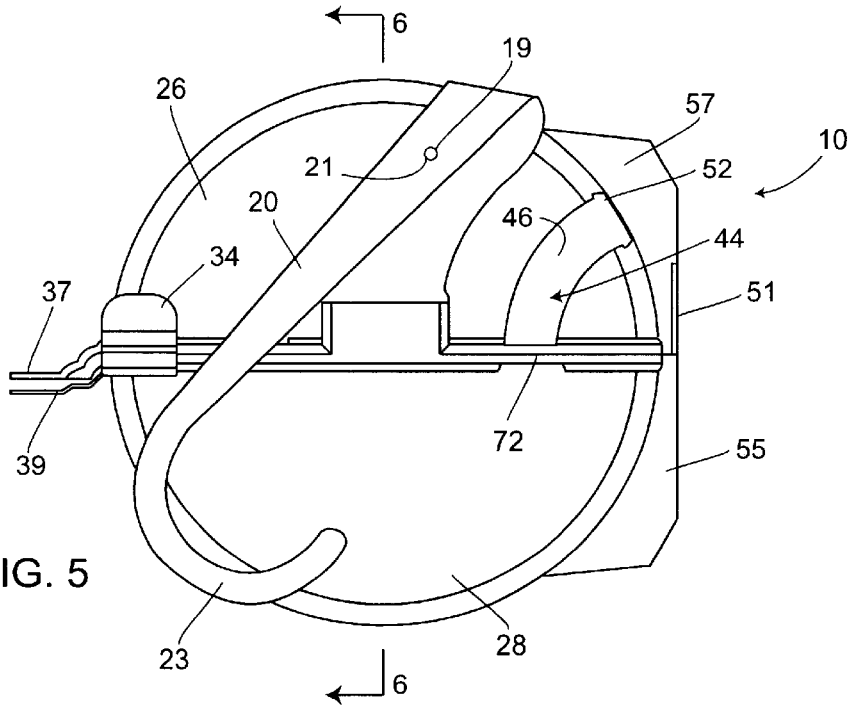
FIG. 5 is a side view of the dispenser of FIGS. 1, 2 and 3.
Figure 6:
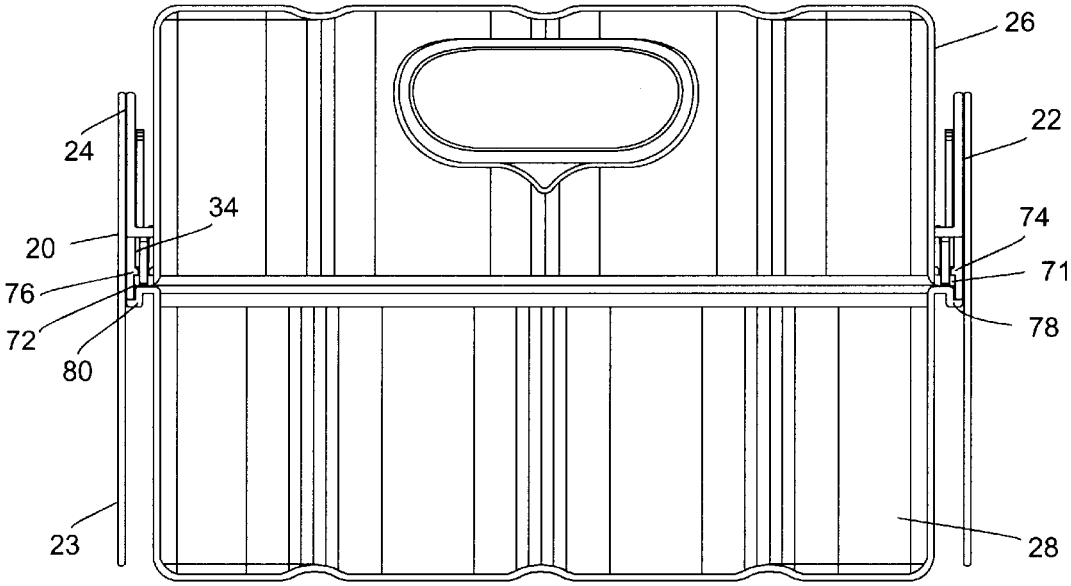
FIG. 6 is a cross-sectional view taken along line 6—6 of FIG. 5.

Referring to FIGS. 5 and 6, the dispenser 10 is shown in a closed configuration. The housing sections 26 and 28 are sealed together at the sides of the dispenser 10 along lines 71 and 72. Sealing is effected by the mating of flanges 74 and 76 which contact support surfaces 78 and 80. Thus, this sealing means along the sides of dispenser 10 cooperate with the rearwardly positioned living hinge 30 and the step configuration of the flanges 37 and 39 (FIG. 4) to seal the interior of the dispenser 10 containing the roll of moist tissue from the atmosphere 32.

Figure 7:
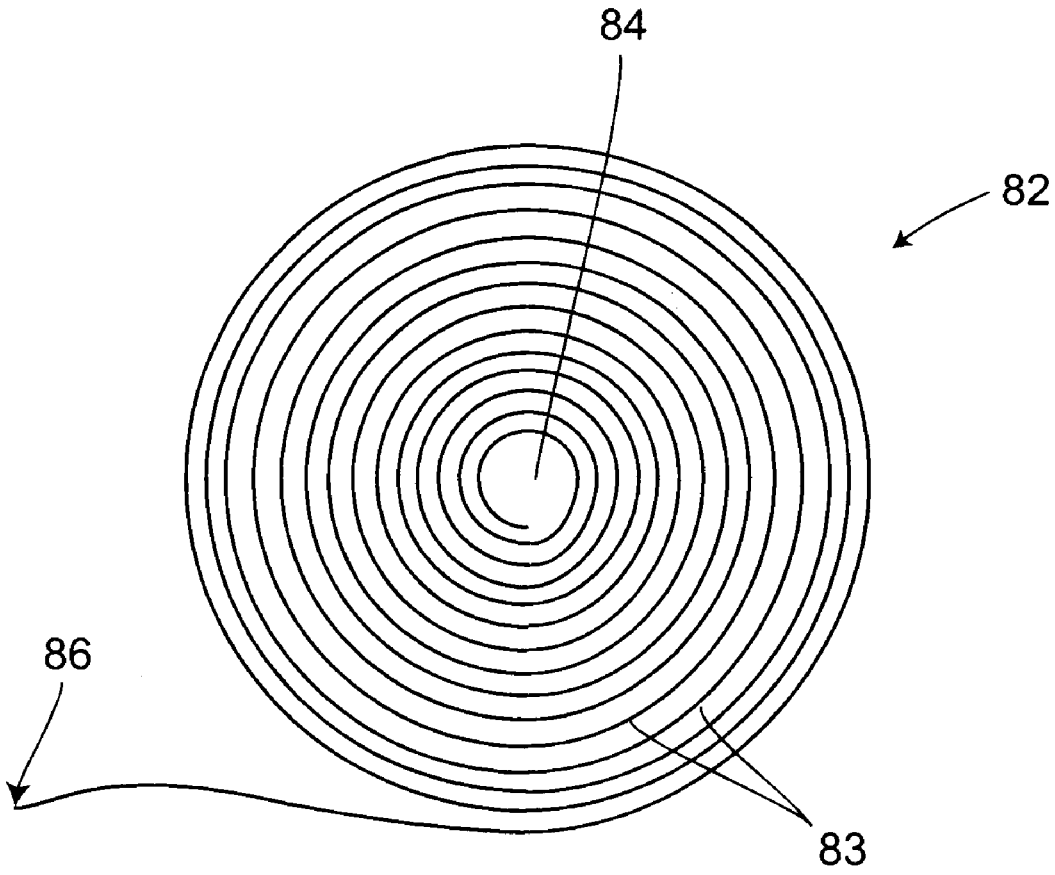
FIG. 7 is a side view of the preferred configuration of a roll of moist tissue for use with the dispenser of this invention.

The preferred configuration of a roll of moist tissue for use in the dispenser of this invention is shown in FIG. 7. The roll 82 comprises a sheet 83 of moist tissue which is rolled upon itself in the absence of a conventional hollow cylinder at the center 84 of the roll 82. The leading edge 86 of the sheet 83 extends between the stepped flanges 37 and 39 (FIG. 4) when being dispensed from the dispenser 10.

What is claimed is:

1. A dispenser for housing a roll of moist tissue sheet which comprises:

a hollow housing shaped to store said roll of moist tissue sheet, said hollow housing consisting of a first and second housing section joined together, each of said housing sections having a flange, said flanges being positioned adjacent each other to form a slit on a periphery of said housing when said housing sections are in a closed position, each of said flanges having a stepped inner surface adjacent said slit, said stepped inner surfaces mating with each other to form a path for said moist tissue sheet, a sealing latch means positioned at each of opposing side surfaces of said flanges for joining said flanges together, each of said housing sections having opposing end surfaces, two arms, wherein each of said arms is attached at one end thereof to a respective one of said opposing end surfaces of said first housing section, each of said arms being shaped at an end opposite to said end of said arm attached to said one of said housing sections for hanging said dispenser from a fixed substrate, and a retaining latch means for retaining said housing sections in a partially open position.

2. The dispenser of claim 1 comprising a single molded piece.

3. The dispenser of claim 1 wherein at least one of said flanges includes a slot.

4. The dispenser of claims 1, 2 or 3 wherein each of said arms is attached to said first housing section by a hinge.

5. The dispenser of any one of claims 1, 2 or 3 including means for folding said arms.

6. A dispenser for housing a roll of moist tissue sheet which comprises:

a hollow housing shaped to store said roll of moist tissue sheet, said hollow housing consisting of a first and second housing section joined together, each of said housing sections having a flange, said flanges being positioned adjacent each other to form a slit on a periphery of said housing when said housing sections are in a closed position, each of said flanges having a stepped inner surface adjacent said slit, said stepped inner surfaces mating with each other to form a path for said moist tissue sheet, a sealing latch means positioned at each of opposing side surfaces of said flanges for joining said flanges together, each of said housing sections having opposing end surfaces, two arms, wherein each of said arms is attached at one end thereof to a respective one of said opposing end surfaces of one of said first housing sections, each of said arms being shaped at an end opposite to said end of said arm attached to said first housing section for hanging said dispenser from a fixed substrate, a roll of moist tissue sheet rolled upon itself in the absence of a separate support core, said roll being positioned within said housing sections, and a retaining latch means for retaining said housing sections in a partially open position.

7. The dispenser of claim 6 comprising a single molded piece.

8. The dispenser of claim 6 wherein at least one of said flanges includes a slot.

9. The dispenser of claims 6, 7 or 8 wherein each of said arms is attached to said first housing section by a hinge.

10. The dispenser of any one of claims 7, 8 or 9 including means for folding said arms.

* * * * *